US009085070B2

(12) United States Patent
Skonieczy, Jr. et al.

(10) Patent No.: US 9,085,070 B2
(45) Date of Patent: Jul. 21, 2015

(54) TENSIONER/CUTTER TOOL FOR HOSE CLAMPS

(71) Applicant: Illinois Tool Works Inc., Glenview, IL (US)

(72) Inventors: Wayne J. Skonieczy, Jr., Cary, IL (US); Walter L. Boss, Lindenhurst, IL (US); Daniel R. Pearson, Ingleside, IL (US); Christopher J. Nelli, Schaumburg, IL (US); Kevin J. Carrington, Winfield, IL (US)

(73) Assignee: Signode Industrial Group LLC, Glenview, IL (US)

( * ) Notice: Subject to any disclaimer, the term of this patent is extended or adjusted under 35 U.S.C. 154(b) by 327 days.

(21) Appl. No.: 13/827,455

(22) Filed: Mar. 14, 2013

(65) Prior Publication Data

US 2013/0269824 A1 Oct. 17, 2013

Related U.S. Application Data

(60) Provisional application No. 61/708,452, filed on Oct. 1, 2012, provisional application No. 61/624,889, filed on Apr. 16, 2012.

(51) Int. Cl.

| | |
|---|---|
| ***B25B 25/00*** | (2006.01) |
| ***B65B 13/34*** | (2006.01) |
| ***B65B 13/02*** | (2006.01) |

(52) U.S. Cl.

CPC ..... *B25B 25/005* (2013.01); *B65B 13/027* (2013.01); *B65B 13/345* (2013.01)

(58) Field of Classification Search

CPC .... B65B 13/025; B65B 13/027; B65B 13/22; B65B 13/34; B65B 13/345; B25B 25/005

USPC ..... 140/93.2, 93.4, 150, 123.5, 123.6

See application file for complete search history.

(56) References Cited

U.S. PATENT DOCUMENTS 2,040,576 A * 5/1936 Timmerbeil ..... 140/93.2
2,933,958 A * 4/1960 Koehler et al. ..... 29/566.1

(Continued)

FOREIGN PATENT DOCUMENTS

EP 0371290 A1 6/1990
EP 0687528 A1 12/1995

OTHER PUBLICATIONS

International Search Report for PCT/US2013/036293 dated Jul. 25, 2013.

*Primary Examiner* — Edward Tolan

(74) *Attorney, Agent, or Firm* — Levenfeld Pearlstein, LLC

(57) ABSTRACT

A tension/cutter tool for band-type clamps that include a band for tensioning around an object and a seal for securing the tensioned band around the object, in which the band is bent and severed at the seal to form a J-seal. The tool includes a body, a drive, and a feed wheel mounted to the body and operably connected to the drive. A nose piece includes two rollers and is movably mounted to the body to engage and disengage the two rollers from contact with the feed wheel. The feed wheel and rollers define a band path therebetween. A tail end of the band is fed into the tool, between the feed wheel and the roller and the drive is actuated to tension the band. Upon achieving a desired tension, the seal is engaged with the nose piece and the band is bent to form the J-seal against the seal and the band is cut beyond the J-seal. A controller monitors and controls the tool functions.

21 Claims, 14 Drawing Sheets

(56) References Cited

U.S. PATENT DOCUMENTS 3,333,608 A * 8/1967 Kuoni ..... 140/151
4,934,416 A * 6/1990 Tonkiss ..... 140/93.2
5,566,726 A 10/1996 Marelin
6,073,664 A * 6/2000 Angarola ..... 140/123.5
6,308,760 B1 * 10/2001 Finzo et al. ..... 156/494

* cited by examiner

Top Level Overview

TENSIONER/CUTTER TOOL FOR HOSE CLAMPS

BACKGROUND

Hoses are often connected to fittings, such as cam and groove fittings, that require that a clamp or band is secured around the hose to secure the hose to the fitting. One example of such a hose to fitting connection is on the end of a water transfer hose.

A typical hose clamp includes a band that is formed into a loop or circle and a seal that holds the loop. The seal encircles the overlapped courses of band. To secure the band onto the hose, a tail end of the band is bent up against the edge of the seal (forming a J-seal) and is cut just beyond the J-seal.

One known tool is described and disclosed in Marelin, U.S. Pat. No. 5,566,726 and includes a screw actuated drive which can be fitted to a hand-held drill. One drawback to such a device is that the tool requires the user to hammer the seal closed and to return a gripper portion to a home position to remove the band and to tension a subsequent band.

Another tool is a manual tool in which a lead screw is used to facilitate tensioning. In this tool, again, there is no way in which to determine whether proper tension has been reached. In addition, if the lead screw has been fully threaded but tension has not yet been reached, the gripper has to be reset to complete tensioning.

Other tools have limited take up and/or can only be used in low tension systems.

Accordingly, there is a need for a tensioner/cutter for hose clamps or hose banding tools. Desirably, such a tool can tension the band around the hose with unlimited take-up, form the J-seal and cut the tail end of the band at the seal. More desirably, such a tool provides a consistent tension and provides an easy to use cutting movement. More desirably still, such a tool can be portable or bench mounted and can be powered by battery or supplied AC. Still more desirably, such a tool can include a foot pedal or other device that isolates power unless depressed or actuated.

SUMMARY

A tension/cutter tool is for use with band-type clamps that include a band for tensioning around an object and a seal for securing the tensioned band around the object. The band is bent and severed at the seal to form a J-seal, to secure the tensioned band around the object.

The tool includes a body, a drive and a feed wheel mounted to the body and operably connected to the drive for rotational movement. A nose piece is movably mounted to the body. In a present embodiment, the nose piece is pivotally mounted to the tool.

The nose piece includes two rollers and the nose piece pivots to engage and disengage the rollers from contact with the feed wheel. The feed wheel and rollers define a band path therebetween. A cutter assembly is operably connected to the nose piece. The nose piece can be mounted by a spring to bias the nose piece and rollers toward the feed wheel.

An end tail of the band is fed into the tool, between the feed wheel and the roller and the drive is actuated to tension the band. Upon achieving a desired tension, the seal is engaged with the nose piece and the band is bent to form the J-seal against the seal and the band is cut beyond the J-seal.

A guide can be used to direct the band into the band path, and a shear element can be positioned adjacent the guide.

The cutter assembly can include a cradle having a lip and a support surface. When the seal is received in the cradle, the cradle supports the seal, and the lip urges the seal to sever the band at the shear element.

The tool can include a cutter/release lever on which the cutter assembly is mounted.

Alternately, the tool can include a cutter link pivotally mounted to the tool, such that the cutter assembly is mounted to the cutter link to engage the seal with the cradle as the tool and seal are rolled onto one another. In such a configuration, a roller is mounted to the link opposite the cutter assembly. The roller is configured to engage an arcuate surface to pivot the cutter assembly.

A control system is used to control the tool. The control system can be configured to adjust the tension drawn in the band. An actuating trigger or switch actuates the drive. The control system can include a controller for determining an object (e.g., hose) type and for setting a tension appropriate for the determined object type.

In such a control system, object types can be catalogued and the object type is selected from the catalog of object types stored within the controller. The controller can also be configured such that multiple depressions or certain time periods of depressing the actuating switch stops and/or reverses operation of the motor. The tool can also include an indicator for indicating a status of the tool. Such an indicator can be a visual and/or an audible indicator.

The tool can be portable and as such powered by, for example a battery. The tool can also be configured for use with local (AC) power or other power sources.

These and other features and advantages of the present invention will be apparent from the following detailed description, in conjunction with the appended claims.

DETAILED DESCRIPTION

While the present device is susceptible of embodiment in various forms, there is shown in the figures and will herein-after be described a presently preferred embodiment with the understanding that the present disclosure is to be considered an exemplification of the device and is not intended to be limited to the specific embodiment illustrated.

Figure 11A:
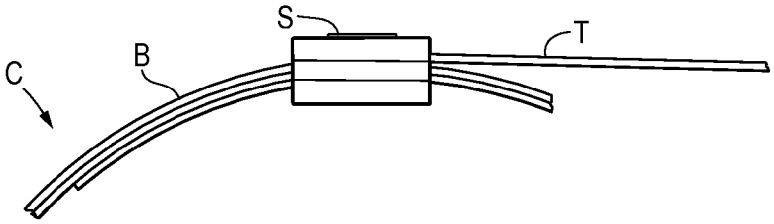
FIGS. 11*a* and 11*b* illustrates a band prior to forming the seal (FIG. 11*a*) and a typical J seal formed on the band (FIG. 11*b*)
Figure 11B:
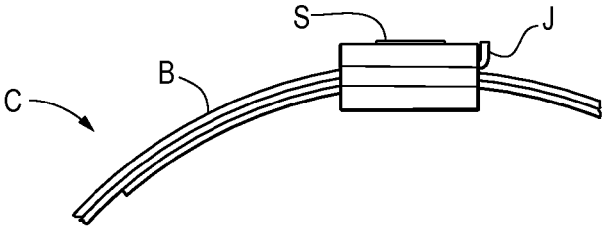

Referring to the figures and in particular to FIGS. 1-5 there is shown a tensioner/cutter tool 10 for hose clamps C. The tool 10 is used to tension a hose clamp or band B around a hose H (see, for example, FIG. 11*a*), form a J-seal J of the tensioned band B and cut the end tail T of the band B after the J-seal J has been formed (see, for example, FIG. 11*b*).

One embodiment of the tool 10 includes, generally, a body 12 that encloses a powertrain 14, a housing 16 which houses the body 12 and a controller 18, a power supply 20, such as the exemplary battery pack, a nose piece 22, a feed or tension wheel 24 and a cutter and release lever 26.

A motor 28 is operably connected to the powertrain 14, which in turn is operably connected to the feed wheel 24 by a drive shaft 30. The powertrain 14 converts the rotational movement of the motor 28 to provide a desired power (torque) to the feed wheel 24 to tension the band B.

The nose piece 22 is a carriage that is moveably mounted to the body 12, preferably pivotally mounted, by a pivot pin 32. The nose piece 22 includes a pair of rollers 34*a* and 34*b* which function as pinch wheels to pinch the band B between the rollers 34*a* and 34*b* and the feed wheel 24. The nose piece 22 is mounted to the body 12 by a biasing element 36, such as the illustrated spring to bias the rollers 34*a* and 34*b* toward and into contact with the feed wheel 24. The rollers 34*a* and 34*b* are mounted to the nose piece 22 by roller pins 38. Two rollers 34*a* and 34*b* are provided to increase the surface area over which the band B contacts the feed wheel 24. This can reduce milling of the band B and allow tension to be drawn on softer band B materials.

A connecting plate 40 mounts to an end of the drive shaft 30 and to the pivot pin 32 that mounts the nose piece 22 to the body 12. In this arrangement, the feed wheel 24 and nose piece 22 are secured to the tool 10, and the nose piece 22 can pivot about the pivot pin 32 to bring the rollers 34*a* and 34*b* into contact with the feed wheel 24.

An alignment or guide plate 42 is mounted to a front lower portion of the nose piece 22. The alignment plate 42 is configured to provide a guide (as indicated at 43) for the band end tail T to be positioned in the tool 10. A shear plate 44 is positioned adjacent to and below the alignment plate 42. The shear plate 44 defines a lower portion of the guide 43 and also serves as an anvil against which the band B is held during the cutting operation. The alignment plate 42 and shear plate 44 can be secured to the nose piece 22 by fasteners 46, such as the illustrated screws.

The cutter and release lever 26 is mounted to the nose piece 22. The lever 26 includes an elongated handle 48 and a cutter portion 50. The cutter portion 50, which is at the pivot end of the lever 26 has a cradle 52 that includes a lip 54, a support surface 56 and a pivot or contact corner 58. The lever 26 is mounted to the nose piece 22 by a pivot pin 60. The cutter portion 50 can be an element separate from the lever 26 and secured thereto by fasteners or pins 51 to facilitate replacement of the cutter portion 50. Alternately, the cutter portion 50 can be formed integral with the lever 26. The cutter and release lever 26 provides a number of functions. First, as the tool 10 is pivoted or rolled up onto the seal S and the lever 26 is pivoted forward, away from the body 12, it provides a seat into which the seal S rests as the end tail T of the band B is bent to form the J-seal J. Second, as the lip 54 engages the end of the seal S, it forces the seal S downward to cut the end tail T on the shear plate 44, at the end of the J-seal J. Third, as the lever 26 is rotated rearward, toward the body 12, it pivots the nose piece 22, against the spring 36 bias to move the nose piece 22 and the rollers 34*a* and 34*b* away from the feed wheel 24, thus creating the gap G between the feed wheel 24 and the rollers 34*a* and 34*b*.

The control system or controller 18 includes circuitry to sense the tension on the band B, preferably by measuring the current drawn by the motor 28, and appropriate circuitry or programming, to stop the motor 28 when a desired tension is reached. A tension adjuster 64, such as a manual or electronic dial, knob, button or the like can be provided to set the desired tension. Indicators 68, such as LEDs can be used to provide visual indication of the cycle of the tool 10, the achievement of the desired tension, as well as other operator indicators, for example, battery 20 power. A trigger or actuating switch 66 closes a circuit to commence the tensioning cycle.

Alternately, the tension adjustment function can be incorporated into the trigger or actuating switch 66. For example, the switch 66 can be used to enter a set-up mode in which the tension adjustment can be made by depressing the switch 66 a predetermined number of times to set the tension and then exit the set-up mode.

Figure 12A:
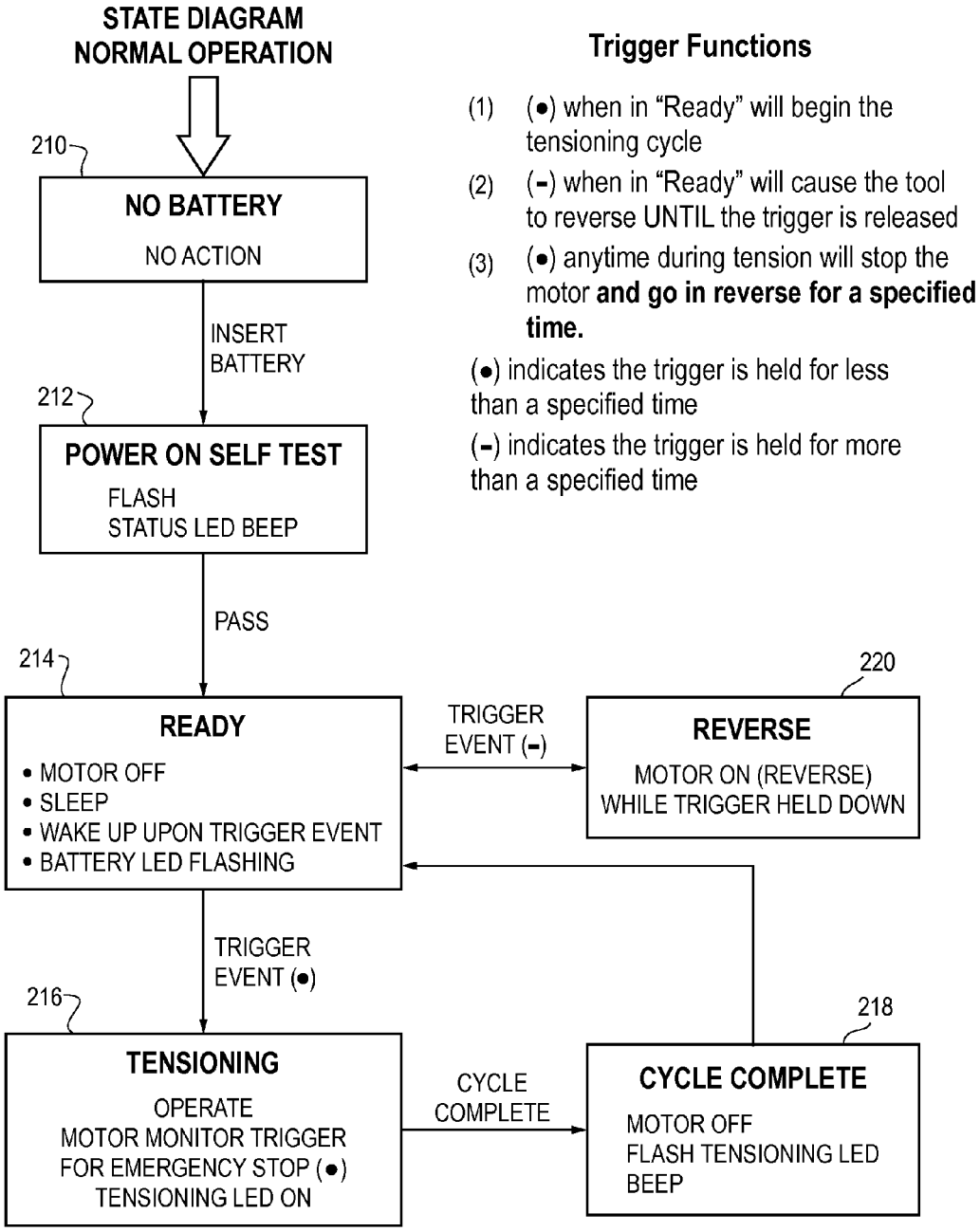
FIGS. 12*a* and 12*b* are flow charts of various operational schemes for the tool.
Figure 12B:
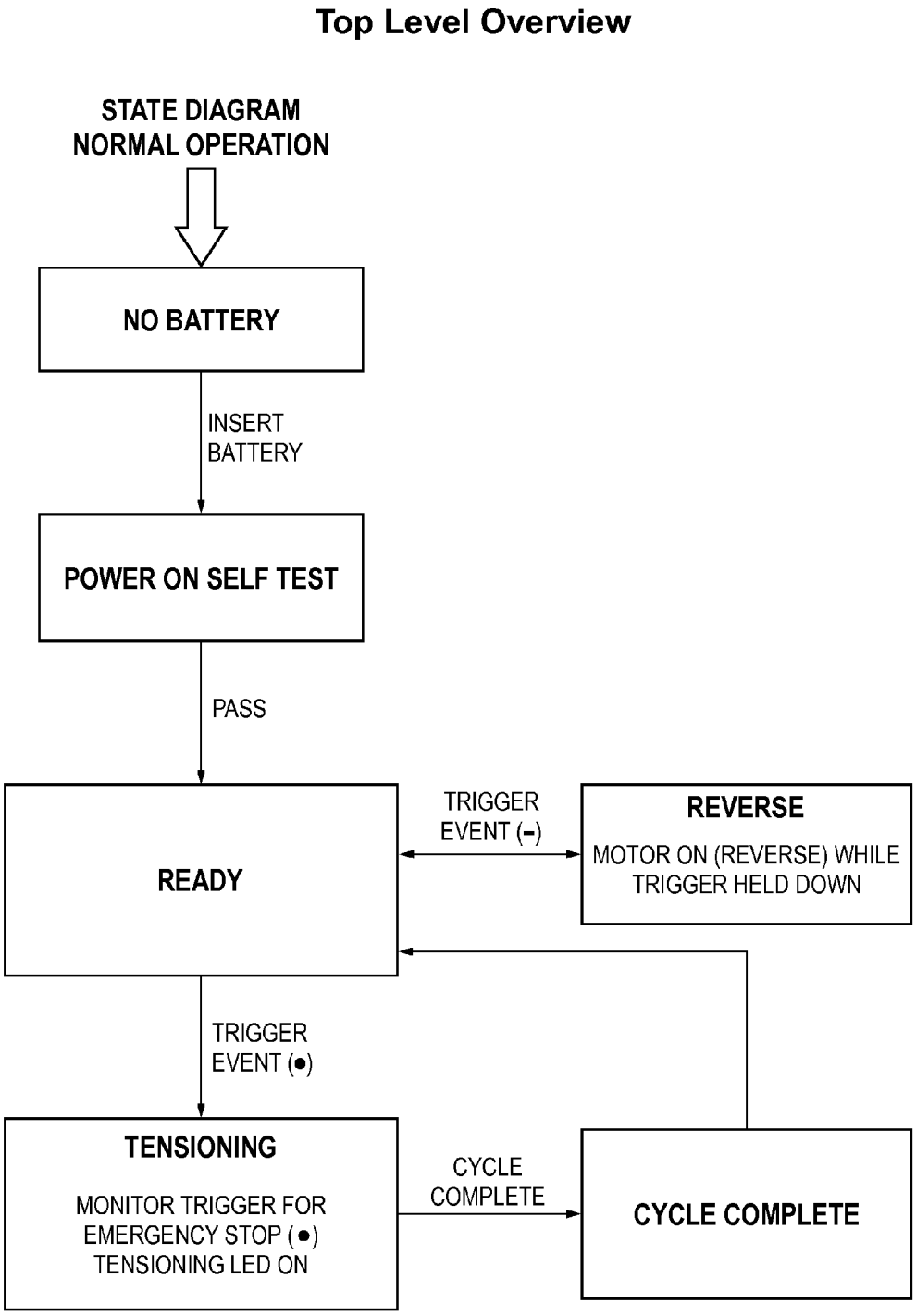

The controller 18 can also be configured to provide various automatic functions. In an embodiment, the controller 18, in conjunction with the actuating switch 66, provides both indication (e.g., of the status of the tool 10 and/or mode of operation) and control of tool 10 functions. FIG. 12*a* is one such operating scheme for the controller 18 and the tool 10.

At step 210 the controller 18 recognizes that a battery 20 has been inserted into the tool 10. At step 212 the tool 10 performs a self-test. Indication can be provided by, for example, a lighting scheme (e.g., flashing) of a lamp such as an LED 68 in the tool 10. When the controller 18 determines that the tool 10 has successfully passed the self-test, it enters ready mode.

In ready mode, at step 214 the motor 28 is off (e.g., in sleep mode), but ready to actuate. Upon actuation by, for example, depressing the actuating or trigger button 66, the tool 10 enters an operating or tensioning mode at step 216. The LED 68 can be used to indicate the state of the tool 10 and the mode, as desired. The motor 28 then commences to tension the band B until the desired tension is reached at which time the motor 28 stops, as at step 218. The tension cycle is then complete, and the LED 68 can illuminate (flash, steady or any pattern) or remain off, to indicate completion of the cycle.

The controller 18 can be configured such that a second depression of the switch 66 during the tension cycle stops and/or reverses operation of the motor 28. Alternately, the controller 18 can be configured such that depressing and holding the switch 66 reverses the motor 28, as at step 220, to relieve tension in the band B. An audible indictor can also be used instead of, or in conjunction with, the visual indicator. Those skilled in the art will appreciate that because the controller 18 can be configured or programmed, there are a wide variety of tool 10 functions, including control and monitoring functions, that can be achieved and that such other functions are within the scope and spirit of the present disclosure.

In use, a clamp C having a band B and a seal S is positioned around a hose H and fitting. The cutter and release lever 26 is urged toward the tool body 12 to pivot the nose piece 22 which moves the rollers 34*a* and 34*b* away from the feed wheel 24, opening the gap G. The end tail T of the band B is positioned between the feed wheel 24 and the rollers 34*a* and 34*b* and the lever 26 is released.

The trigger or actuator button 66 is depressed which actuates the motor 28, turning the feed wheel 24. The spring 36 biases nose piece 22 and thus the roller 34*a* and 34*b* toward the feed wheel 24 to capture the end tail T between the feed wheel 24 and the rollers 34*a* and 34*b*. In addition, as the seal S begins to move into the nosepiece 22, this also increases the clamping force on the band B, by further urging the nosepiece 22 (and rollers 34*a* and 34*b*) against the band B and into the feed wheel 24.

As the feed wheel 24 rotates, it draws tension in the band B, tightening the band B around the hose H. When a predetermined tension is reached, the motor 28 stops, but the drivetrain 14 maintains tension in the band B. The feed wheel 24 then reverses slightly, but not so much as to lose tension in the band B. Alternately, tension can be drawn in the band B, the feed wheel 24 can be reversed slightly, and then the band B retensioned to a final tension.

Over-tensioning the band B (but not so much as to exceed the material yield strength) is done to remove pockets that may have occurred due to friction between the overlapping band B courses. Slightly backing-off from the over-tension point then allows for forming the J-seal J at a desired seal strength, without over-tensioning the band B during the J-seal J forming step.

Alternatively still, the tension can be slowly increased to reach the desired tension without over-tensioning and backing-off. It will thus be appreciated by those skilled in the art that the final tension can be achieved in a variety of manners of operation.

Figure 7B:
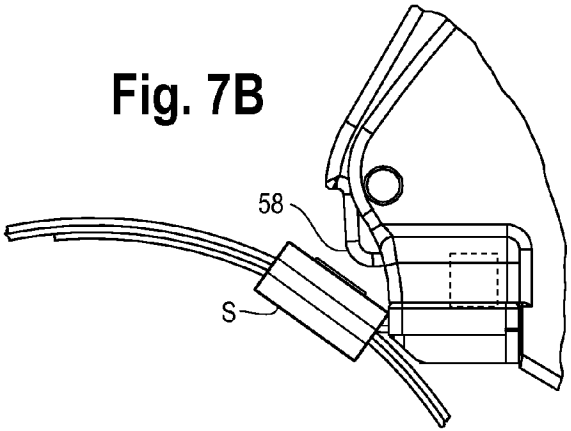
FIGS. 7*a* through 7*f* are enlarged and partial views of the seal cradled in the cutter assembly (FIGS. 7*a*-7*d*) and rotation of the handle as the seal is cradled (FIG. 7*e*) and the tail end of the band is cut (FIG. 7*f*)
Figure 7D:
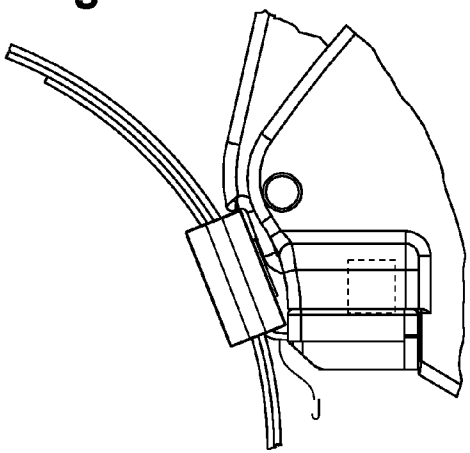
Figure 7A:
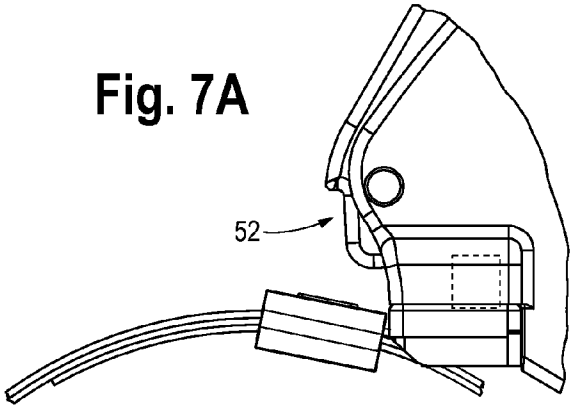
Figure 7C:
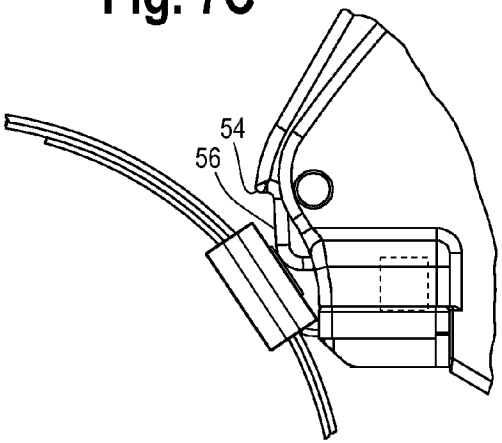
Figure 7F:
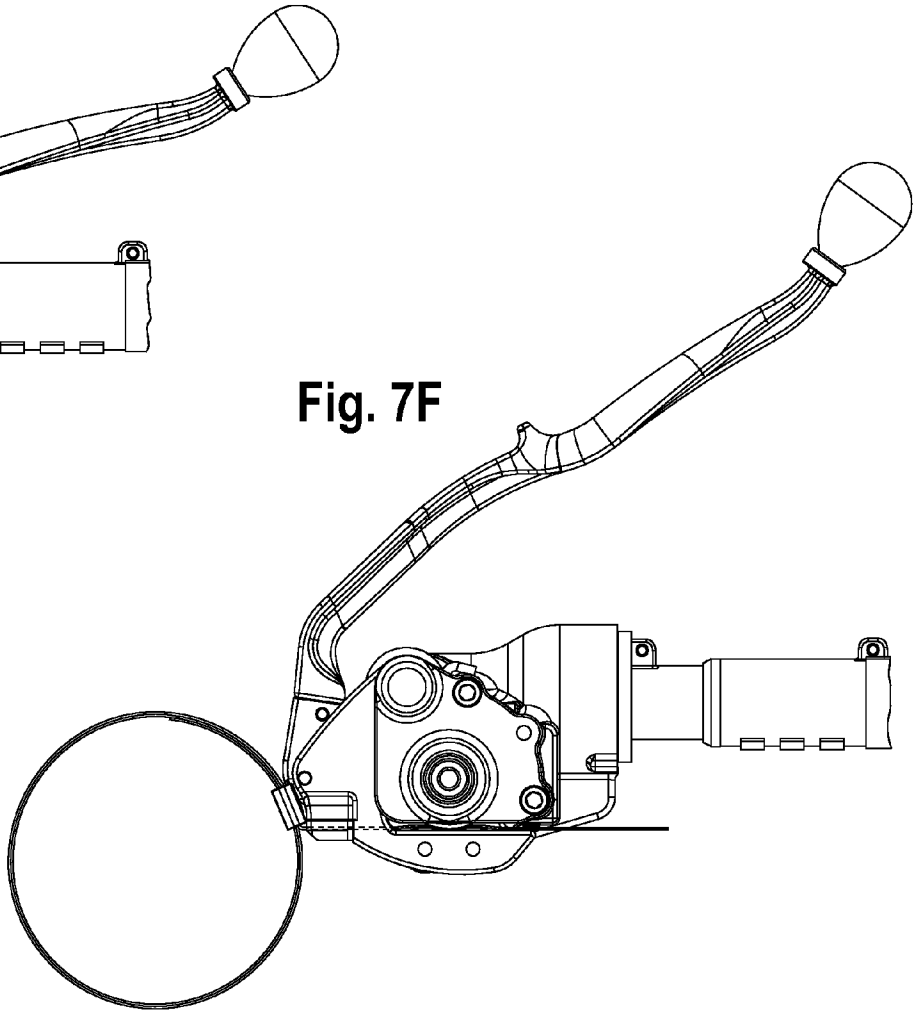
Figure 7E:
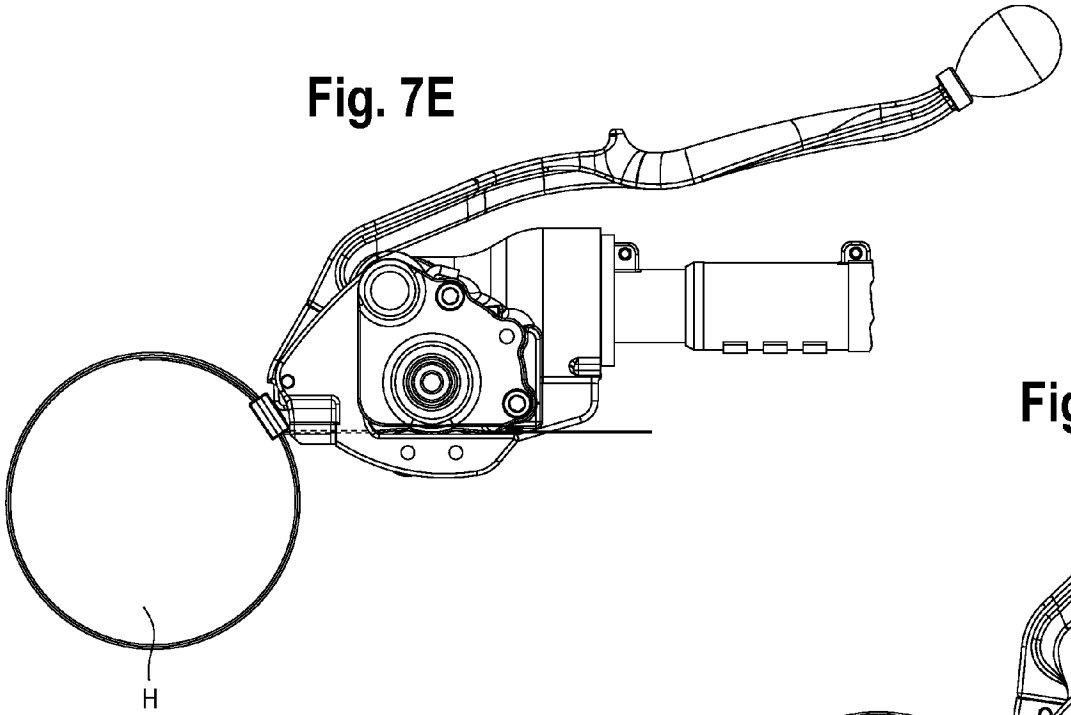
Figure 8C:
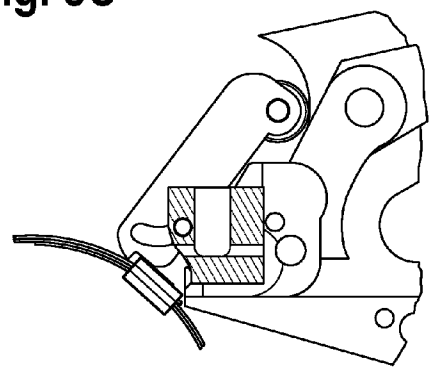
FIGS. 8*a* through 8*e* illustrate an alternate cutter assembly in which cutting is carried out automatically.
Figure 8B:
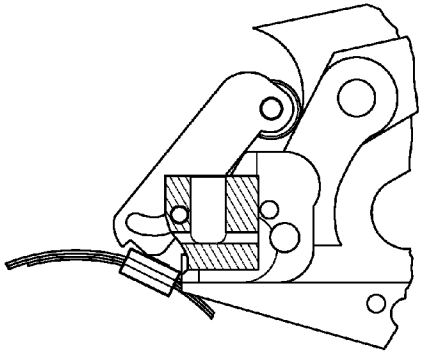
Figure 8A:
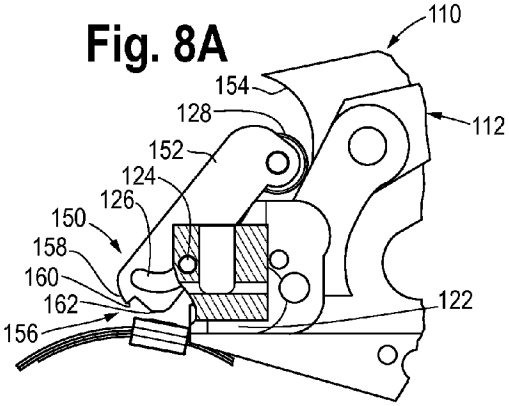
Figure 8E:
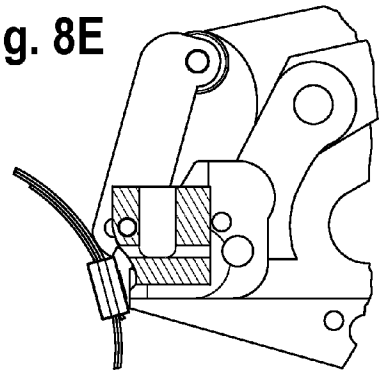
Figure 8D:
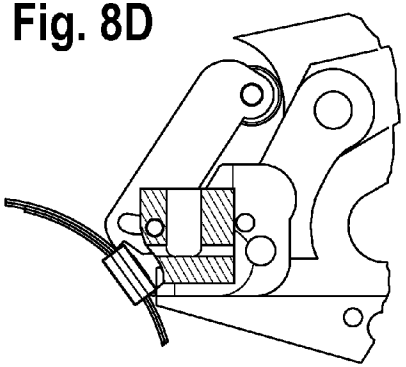

The tool 10 is then rolled up toward and onto the seal S. As the seal S contacts the pivot or contact corner 58, the force on the corner 58 tends to move the lever 26 forward toward the cutting position, which moves the support surface 56 against the seal S (essentially, as seen in FIG. 7*d*, the seal lies S flat on the support surface 56). Once the seal S is fully seated in the cradle 52, the lever 26 is further urged forward which forces the seal S down to form the J-seal J and to cut the end tail T of the band B. The hose H is thus separated from the end tail T, and can be used. Moving the lever 26 rearward, toward the body 12, opens the nose piece 22 and allows for easy removal of the end tail T that remains between the feed wheel 24 and the rollers 34*a* and 34*b*.

In an alternate embodiment, as seen in FIGS. 8*a* through 8*e*, the cutter 150 has an automatic actuation configuration. In this arrangement, the cutter 150 is automatically actuated (as opposed to actuated by the cutter and release lever). The cutter 150 includes a cutter link 152 that is mounted to the nose piece 122 by a link pin 124. The link pin 124 rides in a slotted opening 126 in the link 152. A roller or bearing 128 is positioned at a rear of the link 152 that cooperates with an arcuate surface 154 on the body 112.

A cradle 156 that includes a lip 158, a support surface 160 and a pivot or contact corner 162 is formed at an end of the link 152 opposite the roller 128. As seen in FIGS. 8*a*-8*e*, the tool 110 is rolled up toward and onto the seal S (see, FIGS. 8*a*-8*b*). As the seal S contacts the pivot or contact corner 162, the force on the corner 162 tends to pivot the link 152 about the link pin 124. The roller 128 rides up along the arcuate surface 154 (see, FIG. 8*c*), which moves the support surface 160 against the seal S. Once the seal S is fully seated in the cradle 156, further rolling the tool 110 up on the seal S moves the link roller 128 up along the surface 154, which forces the seal S down to form the J-seal J and to cut the end tail T of the band B (see, FIG. 8*e*).

Figure 9A:
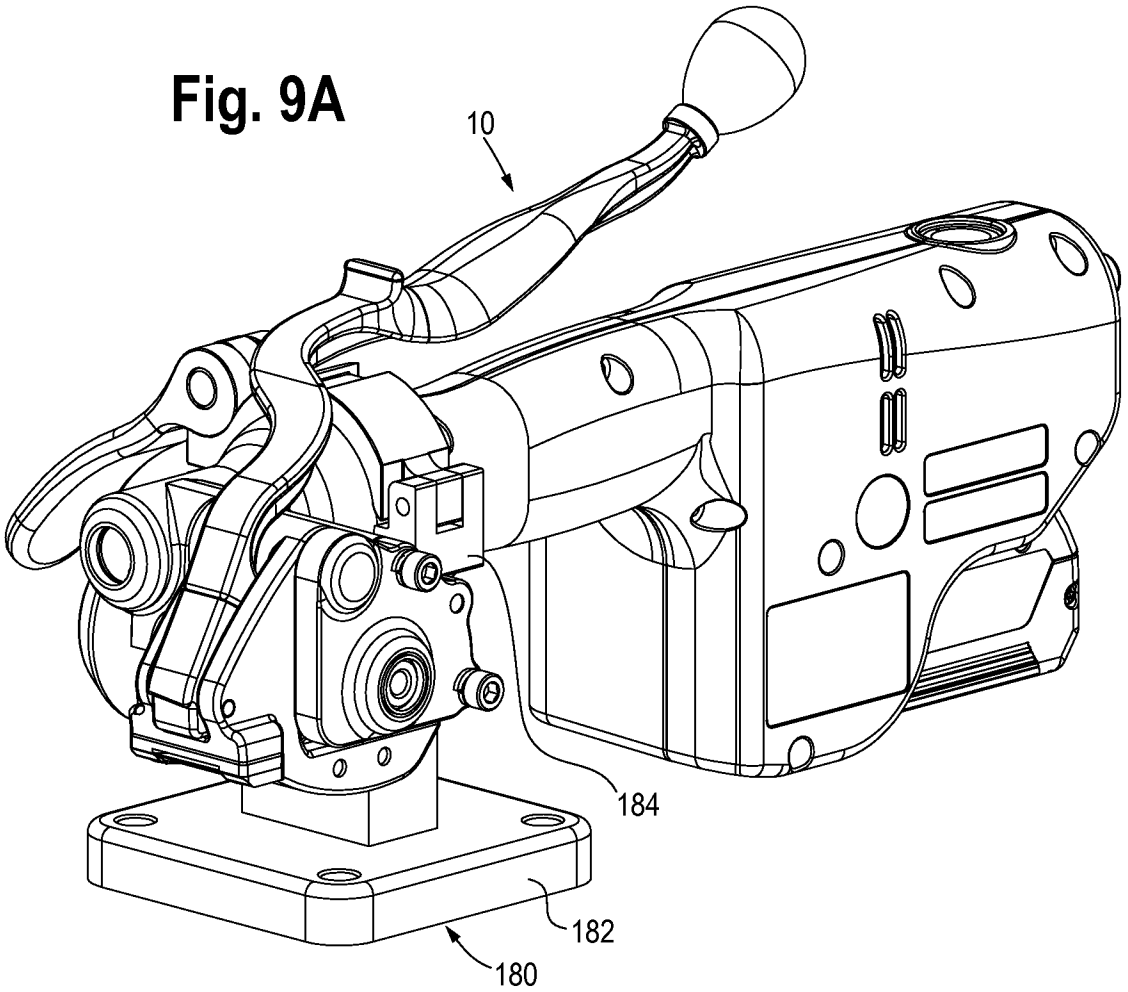
FIGS. 9*a* and 9*b* illustrate a bench mount for the tensioner/cutter tool.
Figure 9B:
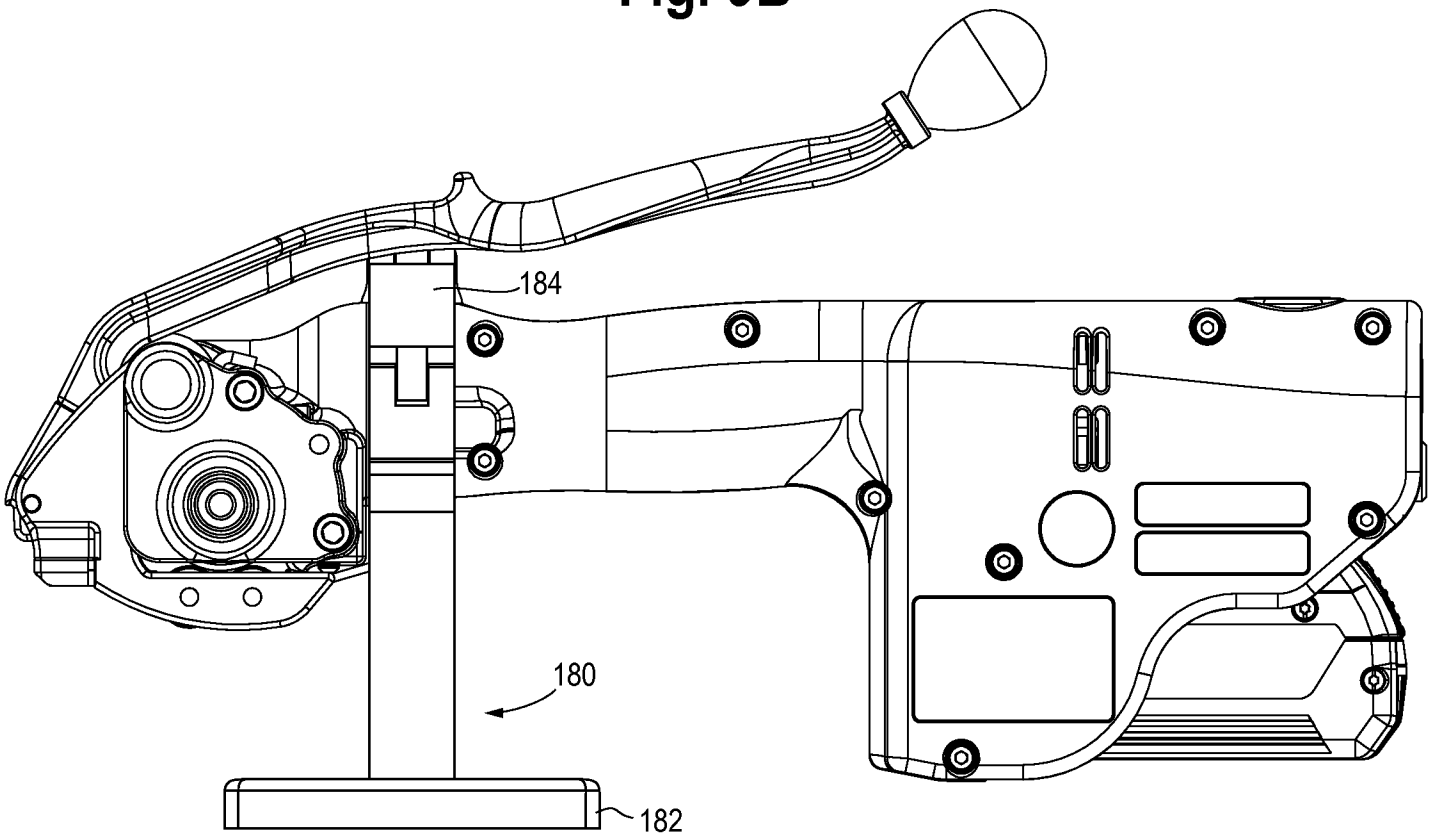

As best seen in FIGS. 9*a* and 9*b*, the tool 10 can be bench mounted. In such an arrangement, the tool 10 is secured in a mount 180 that includes a base plate 182 that can be mounted to a bench top, a movable cart or the like. The mount 180 preferably includes a fully opening quick release clamp 184, such as the illustrated cam-lock clamp, that can be readily opened or closed to secure the tool 10 in place.

Figure 1:
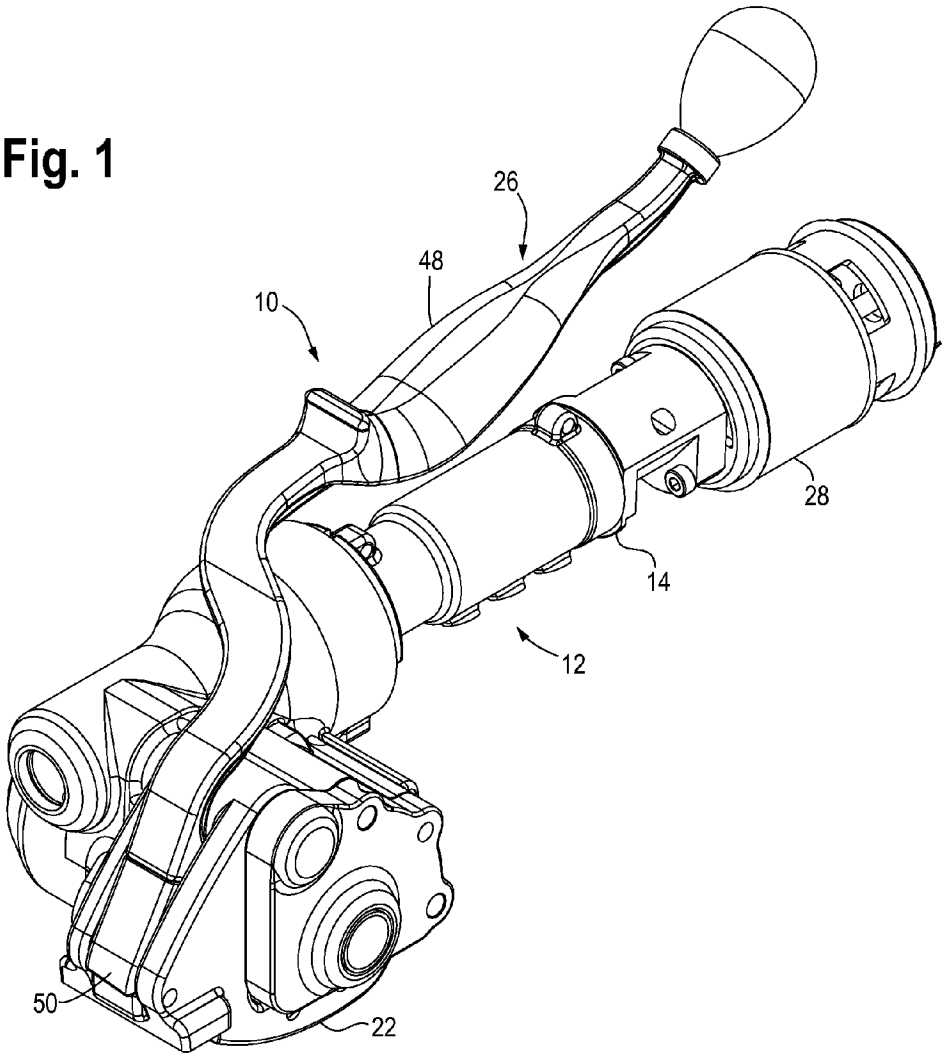
FIG. 1 is a perspective view of a hose clamp tensioner/cutter tool shown without a portable battery pack.
Figure 3:
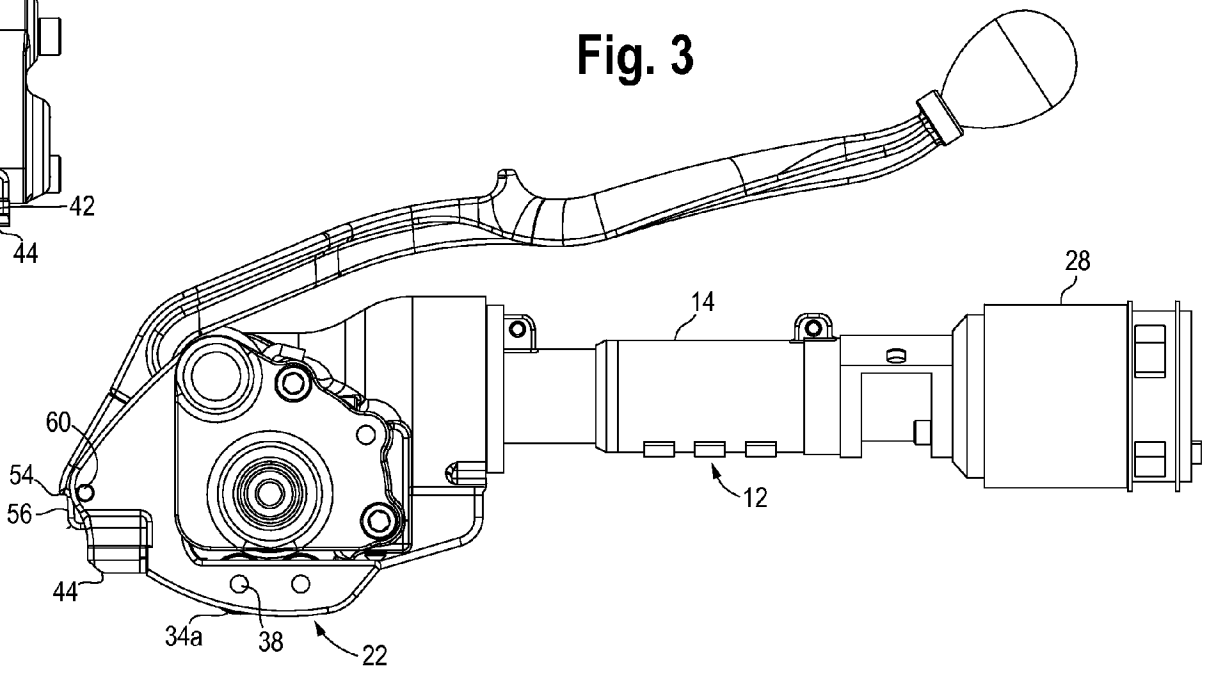
FIG. 3 is a side view of the tensioner/cutter tool.
Figure 2:
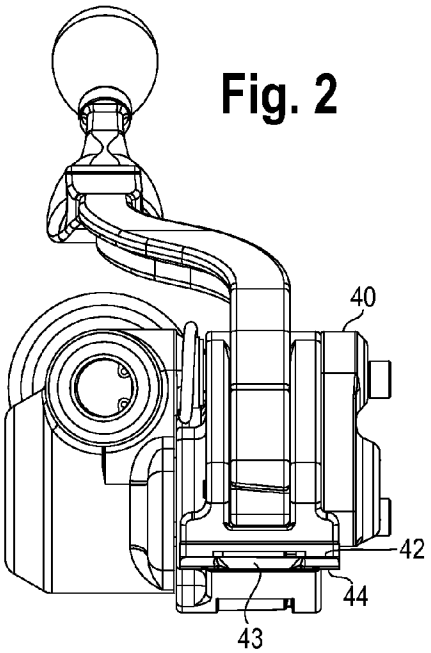
FIG. 2 is a front view of the tensioner/cutter tool.
Figure 4:
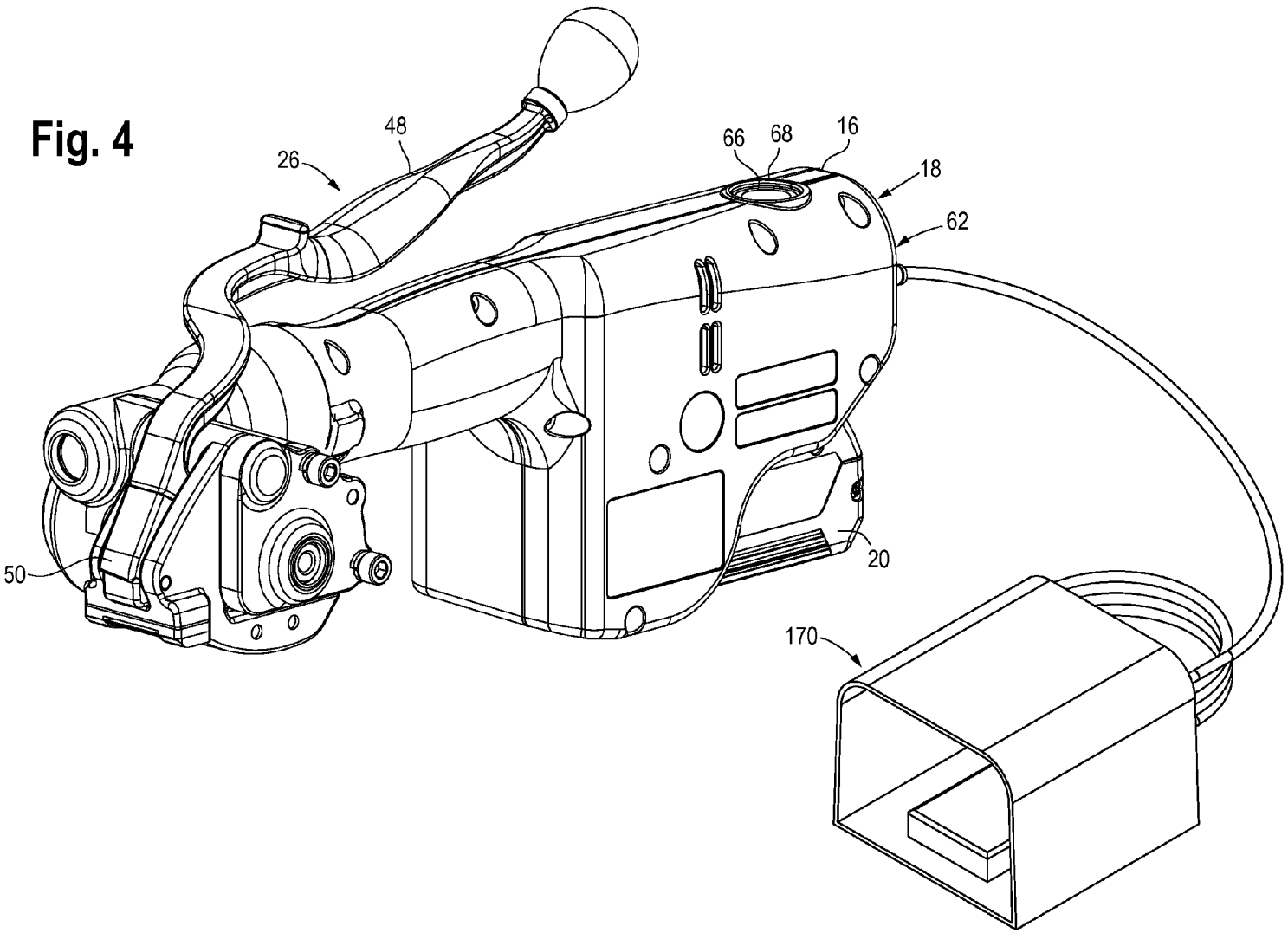
FIG. 4 is a perspective view the tensioner/cutter tool shown with a portable battery pack.
Figure 5:
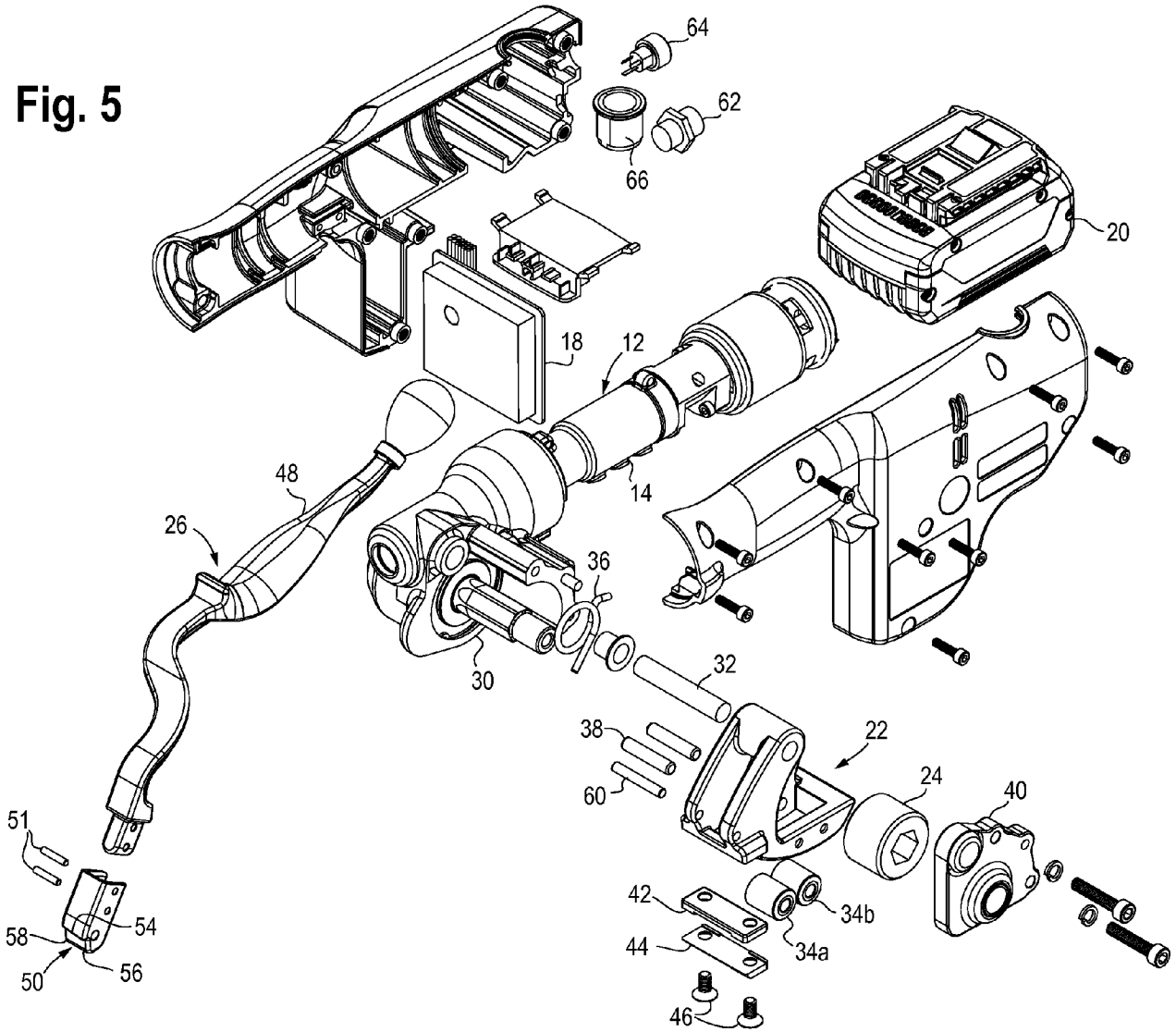
FIG. 5 is an exploded view of the tensioner/cutter tool.
Figure 6B:
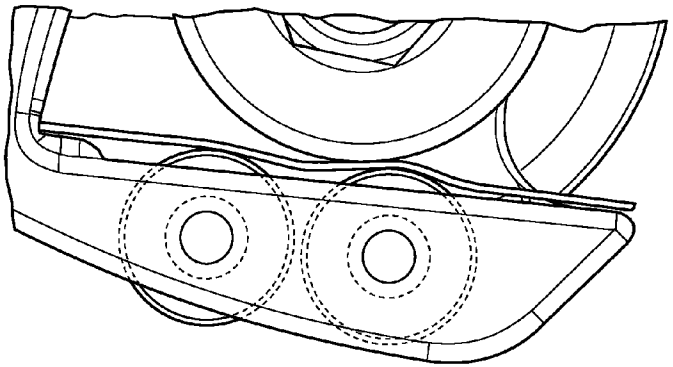
FIGS. 6*a* through 6*f* are enlarged side views of the tension wheel and rollers as the tail end of the band is fed into the tool and as the band is tensioned.
Figure 6C:
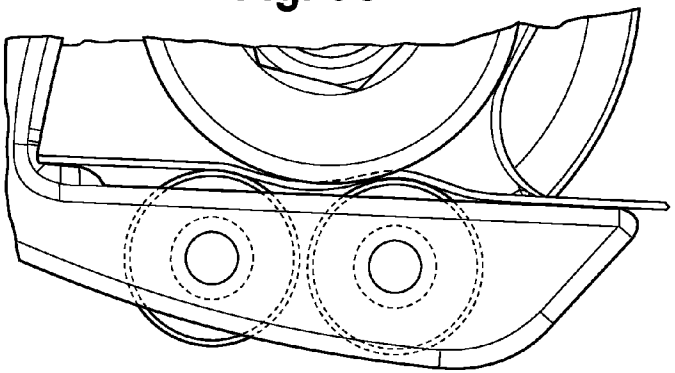
Figure 6A:
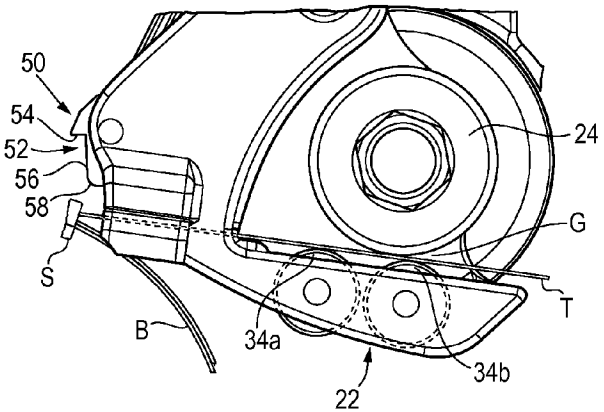
Figure 6E:
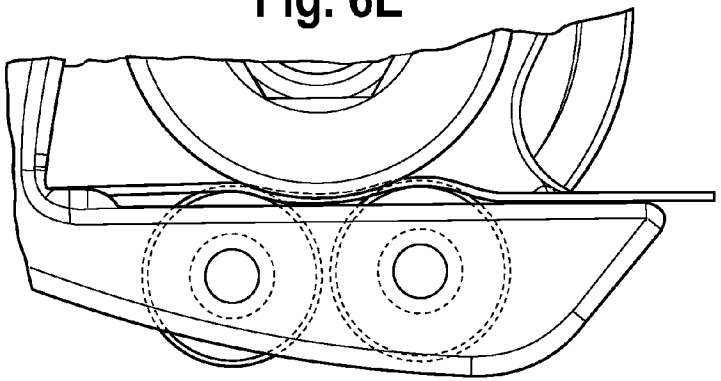
Figure 6D:
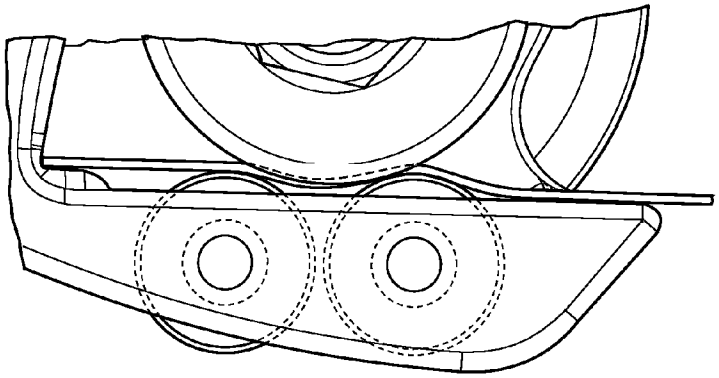
Figure 6F:
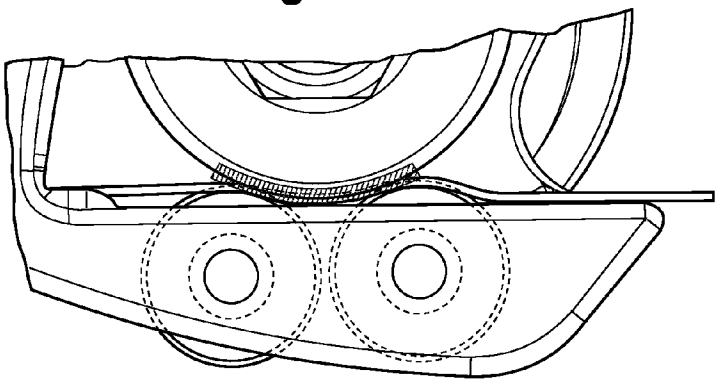

The tool can include a foot pedal 170 as illustrated in FIG. 4. The foot pedal 170 can be used in lieu of the switch (66 as seen in FIG. 4), or as an alternative switch. The foot pedal 170 is operably connected to the controller 18 via, for example, socket 62, such that the foot pedal 170 must be depressed in order for the tool 10 to operate and releasing the foot pedal 170 will automatically stop and/or reverse operation of the tool 10.

It is also anticipated that the controller 18 can be used to provide preset tension values for a variety of hose H types and sizes, band B types and sizes and the like. The controller 18, in conjunction with appropriate sensors (e.g., within the controller 18) can also be configured to detect the type of hose H, e.g., hose-detection technology, which will allow the tool 10, 110 to determine the type of hose H on which it is used and to apply an appropriate tension to achieve a desired J-seal J strength. In one embodiment, this can be achieved using a relationship between force and current (as drawn by the motor 28) over a predetermined period of time.

It is anticipated that the hose detection methodology can be accomplished in a number of ways. In one methodology, various hoses will be tested by tensioning bands B to an appropriate tension over a period of time. The time and motor 28 current will be recorded and a slope of the curve, which is assumed to be a near straight-line, will be calculated. The slope for each type of hose H will be determined in this manner and the slope for each hose H type will be catalogued. The controller 18 will be programmed with the catalog of hose H types and slopes. In this manner, as the tool 10, 110 commences tensioning, the controller 18 will recognize the type of hose H from the catalog of time-motor current slopes and will adjust the tool 10, 110 to achieve the proper final tension accordingly.

Figure 10:
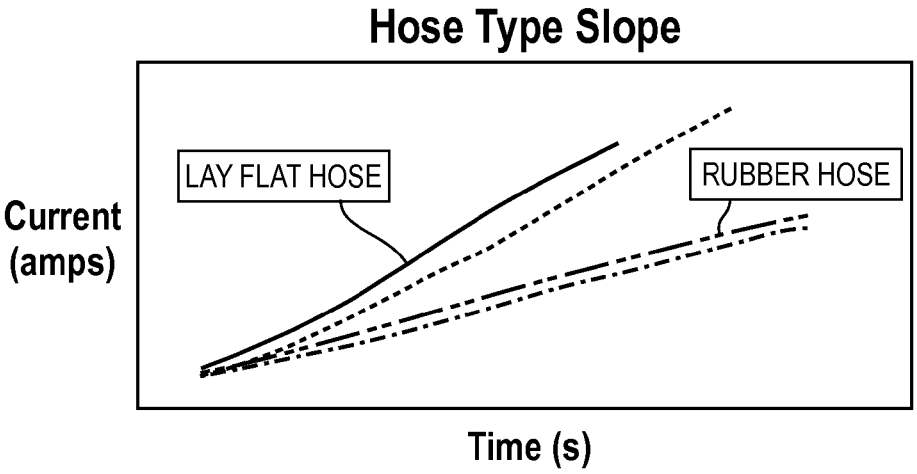
FIG. 10 is a graphical illustration of the current in amps drawn by the motor plotted against time for various types of hose.

FIG. 10 is a graphical representation of the tension rate curves (current v. time) for two different hoses, a lay flat hose and a rubber hose, from which the proper tension rate and final band B tension can be determined.

It will be appreciated by those skilled in the art that the relative directional terms such as upper, lower, rearward, forward and the like are for explanatory purposes only and are not intended to limit the scope of the disclosure.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover all such modifications as fall within the scope of the claims.

What is claimed is:

1. A tension/cutter tool for band-type clamps that include a band for tensioning around an object and a seal for securing the tensioned band around the object, the band being severed and bent at the seal to form a J-seal, to secure the tensioned band around the object, the tool comprising:

a body;

a drive;

a feed wheel mounted to the body and operably connected to the drive for rotational movement;

a nose piece movably mounted to the body, the nose piece including two rollers, the nose piece pivotally moving to engage and disengage the two rollers from contact with the feed wheel, the feed wheel and rollers defining a band path therebetween; and a cutter assembly operably connected to the nose piece, wherein a tail end of the band is fed into the tool, between the feed wheel and the roller and the drive is actuated to tension the band, and wherein upon achieving a desired tension, the seal is engaged with the nose piece and the band is bent to form the J-seal against the seal and the band is cut beyond the J-seal.

2. The tool of claim 1 wherein the nose piece is pivotally mounted to the body.

3. The tool of claim 2 wherein the nose piece is biasedly mounted to the body by a spring, the nose piece being biased toward the feed wheel.

4. The tool of claim 1 including a guide for directing the band into the band path, and a shear element adjacent the guide.

5. The tool of claim 1 wherein the cutter assembly includes a cradle having a lip and a support surface, and wherein when the seal is received in the cradle, the cradle supports the seal, and the lip urges the seal to sever the band at the shear element.

6. The tool of claim 1 including a cutter/release lever.

7. The tool of claim 6 wherein the cutter assembly is on the cutter/release lever.

8. The tool of claim 5 including a cutter link pivotally mounted to the tool, wherein the cutter assembly is mounted to the cutter link to engage the seal with the cradle as the tool and seal are rolled onto one another.

9. The tool of claim 8 including a roller mounted to the link opposite the cutter assembly, the roller configured to engage an arcuate surface to pivot the cutter assembly.

10. The tool of claim 1 including a control system.

11. The tool of claim 10 wherein the control system is configured to adjust the tension drawn in the band.

12. The tool of claim 10 including an actuating switch for actuating the drive.

13. The tool of claim 11 wherein the control system includes a controller for determining an object type and for setting a tension appropriate for the determined object type.

14. The tool of claim 13 wherein the object type is selected from a catalog of object types stored within the controller.

15. The tool of claim 1 including a battery for providing power to the drive.

16. The tool of claim 1 including a mount for mounting the tool to a surface.

17. The tool of claim 12 wherein the controller is configured such that the actuating switch stops operation of the motor.

18. The tool of claim 12 wherein the controller is configured such that the actuating switch reverses a direction of the motor.

19. The tool of claim 10 including an indicator for indicting a status of the tool.

20. The tool of claim 19 wherein the indicator is one or both of a visual and an audible indicator.

21. The tool of claim 11 including an actuating switch for adjusting the tension in the band.

* * * * *

UNITED STATES PATENT AND TRADEMARK OFFICE

CERTIFICATE OF CORRECTION

PATENT NO. : 9,085,070 B2
APPLICATION NO. : 13/827455
DATED : July 21, 2015
INVENTOR(S) : Wayne J. Skonieczny et al.

It is certified that error appears in the above-identified patent and that said Letters Patent is hereby corrected as shown below:

In the Claims:

Column 8, line 25 approx., Claim 19, “indicting” to read as --indicating--.

Signed and Sealed this
Twenty-ninth Day of March, 2016

Michelle K. Lee

Michelle K. Lee
*Director of the United States Patent and Trademark Office*